US010479096B2

(12) United States Patent
Audouard et al.

(10) Patent No.: US 10,479,096 B2
(45) Date of Patent: Nov. 19, 2019

(54) DEVICE AND METHOD FOR INTRODUCING A CARTRIDGE

(71) Applicant: Dover Europe Sàrl, Vernier (CH)

(72) Inventors: Vincent Audouard, Toulaud (FR); Stéphane Collot, Chateaudouble (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/150,800

(22) Filed: Oct. 3, 2018

(65) Prior Publication Data

US 2019/0100016 A1 Apr. 4, 2019

(30) Foreign Application Priority Data

Oct. 4, 2017 (FR) ..... 17 59288

(51) Int. Cl.
*B41J 2/175* (2006.01)

(52) U.S. Cl.
CPC ..... *B41J 2/1752* (2013.01); *B41J 2/1754* (2013.01); *B41J 2/17509* (2013.01); *B41J 2/17553* (2013.01)

(58) Field of Classification Search
CPC ..... B41J 2/175; B41J 2/17509; B41J 2/1752; B41J 2/1754; B41J 2/17553
See application file for complete search history.

(56) References Cited

U.S. PATENT DOCUMENTS 9,132,653 B2 * 9/2015 Takagi ..... B41J 2/1752
9,278,540 B2 * 3/2016 Seki ..... B41J 2/17513
2002/0113851 A1 8/2002 Sasaki et al.
2002/0135634 A1 9/2002 Lodal et al.
2003/0184617 A1 10/2003 Jones et al.
2007/0091154 A1 4/2007 Katayama et al.
(Continued)

FOREIGN PATENT DOCUMENTS

EP 1138501 A2 4/2001
EP 3112169 A1 1/2017
(Continued)

OTHER PUBLICATIONS

European Search Report and European Search Opinion for European patent application No. EP 18 19 8471 dated Feb. 19, 2019.
Search Report for FR 1759288 dated May 25, 2018.

*Primary Examiner* — Anh T Vo
(74) *Attorney, Agent, or Firm* — Pearne & Gordon LLP

(57) ABSTRACT

A device for introducing and maintaining a cartridge in a CIJ-type inkjet printer comprises a first support having two lateral sides, a back side and a front opening, this first support able to contain a cartridge and the back side having a fluidic connector. A second support, called the cartridge support, against which a cartridge can be maintained, can be actuated in rotation about a first axis of rotation extending between the two lateral sides of the first support between a position for loading and unloading a cartridge and a position for connecting a cartridge to the fluidic connector. The second support is, in the position for connecting, contained within the first support and comprises at least an opening this is opposite, or in contact, with the fluidic connector of the back side of the first support. An actuator is provided to rotate the second support about the first axis.

21 Claims, 8 Drawing Sheets

(56) References Cited

U.S. PATENT DOCUMENTS

| | | | | |
|---|---|---|---|---|
| 2007/0229625 | A1* | 10/2007 | Yano | B41J 2/17509 347/86 |
| 2008/0094429 | A1* | 4/2008 | Miyazawa | B41J 2/17503 347/7 |
| 2010/0045755 | A1 | 2/2010 | Kobayashi | |
| 2013/0169720 | A1 | 7/2013 | Nakamura et al. | |
| 2017/0217200 | A1 | 8/2017 | Ribiero et al. | |
| 2018/0045901 | A1 | 2/2018 | Audouard et al. | |
| 2018/0134044 | A1 | 5/2018 | Berbiguier et al. | |

FOREIGN PATENT DOCUMENTS

| | | | |
|---|---|---|---|
| GB | 2279121 | A | 12/1994 |
| WO | 2009047501 | A1 | 4/2009 |

* cited by examiner

DEVICE AND METHOD FOR INTRODUCING A CARTRIDGE

CROSS-REFERENCE TO RELATED APPLICATIONS

This application claims priority from French Patent Application No. 17 59288 filed on Oct. 4, 2017. The content of this application is incorporated herein by reference in its entirety.

TECHNICAL FIELD AND PRIOR ART

The invention relates to the field of printers in particular that of industrial printers that use solvent-based inks, for example CIJ printers.

The ink circuit of these printers has removable reserves of ink and of new solvent contained in cartridges, bottles or containers.

Industrial printers are well known in the field of encoding and industrial marking of diverse products, for example for marking barcodes, the expiry date on food products, or references or distance markings on cables or pipes directly on the production chain and at high speed. Among these printers, some make use of technologies that use solvent-based liquid inks that they deposit on the support/product to be printed. To work, they need a reserve of new ink, and even new solvent in order to supply the printing. By way of example, interest can be given to continuous inkjet printers (CU) that belong to this printer class.

The latter has several typical subassemblies as shown in FIG. 1.

First of all, a print head 101, generally offset with respect to the body of the printer 103, is connected to the latter by a flexible umbilical link 102 that gathers together the hydraulic and electrical connections required for the operation of the head by giving it flexibility that facilitates integration on the production line.

The body of the printer 103 (also called console or cabinet) usually contains three subassemblies:

- an ink circuit in the lower portion of the console (zone 104'), that makes it possible on the one hand, to supply the head with ink at a stable pressure and with suitable quality, and on the other hand to handle the ink of the jets that are not used for the printing;
- a controller located in the top of the console (zone 105'), able to manage the sequencing of actions and to perform the treatments that make it possible to activate the various functions of the ink circuit and of the head,
- an interface 106 that gives the operator the means of implementing the printer and of being informed about the operation thereof.

The ink circuit can be of the type of the one described in EP 0 968 831, where the reserves of ink and solvent (also called additive) are removable cartridges comprising a semi-rigid pouch made of a plastic material, compatible with the fluids concerned. This principle can be found in several machines distributed by major actors in the market such as the product ranges Series 7, 9020, 9030, 9232 from Markem-Imaje or Series 1000 from Videojet (WO 2009/047501).

An example of such a cartridge 100 is shown in FIG. 2.

It comprises a portion 120 (this portion is the most rigid, but can however be deformed somewhat when the cartridge is empty) and a semi-rigid, or flexible, portion 140. The rigid portion 120 is provided with a rigid nipple 160 that allows for a hydraulic connection to the ink circuit.

For the purpose of use in a printer, a cartridge such as the one in FIG. 2 is introduced into a cartridge holder, as shown in FIGS. 3A and 3B.

The cartridge holder has an elongated shape according to a direction X, with this shape being suitable for receiving a cartridge 100 and for maintaining it blocked. It is limited laterally by walls 326, 328 that are parallel to one another (according to a plane parallel to X, Z), and which extend over the entire length L (measured according to the direction X) of the cartridge holder.

A front wall 324 is arranged in a plane parallel to the plane XY and in a portion, referred to as the upper portion, of the device. It extends, along the direction X, only over a small portion of the length L. It connects the lateral walls 326, 328. This front wall has for example a longitudinal extension I, according to X, of about 0.2 L or 0.25 L, allowing as such a wide opening for the introduction of a cartridge into the cartridge holder.

A rear wall 336, parallel to the front wall 324, also connects the lateral walls. It can be perforated, with an opening 328, in the upper portion of the cartridge holder located facing the front wall 324. In a lower end of the rear wall 336, one or several openings 332, 334 make it possible to allow the nipple 160 of a cartridge 100 to pass (see these elements in FIG. 2).

The lateral walls 326, 328 have, according to the axis Z, a width that is sufficient to connect the walls 324 and 336. But this width varies according to the direction X, this width becoming less in order to allow for easy access to the cartridge when the latter is placed in the inside volume of the cartridge holder. For example, beyond the position, according to X, at which the front wall 324 stops, the width $I_2$ of the lateral walls 326, 328 becomes less than the maximum width $I_1$ of these walls, for example less than half of this maximum width.

Lateral cheeks, of which only one 327 can be seen in FIGS. 3A and 3B, can protrude, towards the front of the cartridge holder, from the lateral walls 326, 328, in the narrowest portion of the latter. They participate in the lateral maintaining of a cartridge 100, when the latter is inserted into the device, as can be seen in FIG. 3B.

Towards the front (respectively the rear), the cartridge is maintained by the wall 324 (respectively 336).

Along a vertical axis, the cartridge can be maintained, in the top of the device (in FIG. 3A) by a back or bottom wall (which can be seen in FIG. 4C) and, towards the top, by an edge 337 (which can also be seen in FIG. 4C), but also by the edge of the opening 332 or 334 wherein the nipple 160 of the cartridge can be inserted.

The device therefore offers a wide opening towards the front, allowing for easy insertion and withdrawal of a cartridge.

The unit formed by the cartridge holder provided with a cartridge as shown in FIG. 4C is introduced into a compartment 400 for ink cartridges 100 and solvent cartridges of a printer of the CIJ type; such a compartment is diagrammatically shown in FIG. 4A. Maintained against a rear wall 401 of this compartment, means 105*a*, 105*b*, 105*c* will make it possible to position and to maintain each cartridge holder. Means 112*c*, 114*c* (for example each one in the form of a cannula) make it possible to connect each cartridge, via its nipple 160, to the fluidic circuit of the printer. These means are arranged in the lower or bottom portion of the compartment 400.

An embodiment of the means 105*a* (the means 105*b, c* are identical to 105*a*) is shown in FIG. 4B: they comprise a part in the form of plate 106*a* (respectively 106*b, c*), of a shape that is substantially perpendicular and provided with an indentation or notch 107*a* (respectively 107*b, c*).

An example of an ink cartridge 100 is shown in FIG. 4C, inserted into its case (or cartridge holder) 330. The latter is provided with lateral studs 331, 333 (which can also be seen in FIGS. 3A and 3B) in its upper portion, each one intended to be positioned in one of the notches 107*a-c*. A solvent cartridge is also intended to be inserted into its case of the same type. As explained hereinabove (FIG. 2) the bottom of the rear portion of each cartridge (not visible in the FIGS. 4A-4C) is provided with a nipple 160 for a hydraulic connection to the ink (or solvent) circuit via the means 112*c*, 114*c*. The cartridge holder is configured to allow this nipple for the purpose of this connection to pass through the openings 332 or 334 (FIG. 3A, 3B). It is also configured to allow for a reading of a possible tag arranged against the wall of the cartridge which is turned towards the wall 401 of the compartment 400.

FIG. 4D shows two cartridges 100, 200, each one in a cartridge holder 330, 340, in the compartment 400, the cartridge 100 in the process of being installed. The means 105*a, b, c* are arranged in such a way that two between them are arranged on either side of each cartridge holder, of which the lateral studs 331, respectively 333, come to rest in the corresponding notches 107*a* (respectively b). The hydraulic connection nipple of each cartridge communicates with the ink (or solvent) circuit via the means 112*c*, 114*c*.

The setting into place of the cartridges with this known system therefore requires positioning the cartridge in a cartridge support, locking the cartridge and inserting the whole into the printer.

The current system guarantees correct percussion of the cartridge and the maintaining of the latter during the suction, because:

- the cartridge is positioned and locked by the studs 331, 333, around the percussion zone;
- during the setting in place if the unit formed by a cartridge and a cartridge holder, the trajectory of the cartridge is controlled in relation to the cannula, which makes it possible to guarantee good percussion and to limit the deterioration of the membrane on the side of the cartridge, giving the possibility to strike the same cartridge several times without any leakage.

Such a system can however be further improved, in particular from an ergonomic standpoint.

It is therefore sought to produce a new cartridge support system that makes it possible to:

- maintain the same percussion quality of each cartridge;
- guarantee the correct setting into place in the cartridge support.
- improve the rapidity of implementation and the ergonomics thereof Preferably, such a system comprises a zone for maintaining around the stud.

DISCLOSURE OF THE INVENTION

The invention firstly relates to a device for the introducing and maintaining of a cartridge into an inkjet printer, comprising:

- a first support, delimited by two lateral sides, a back side and a front opening, this first support able to contain a cartridge and the back side being provided with means of fluidic connection;
- a second support, called the cartridge support, able to be actuated in rotation about a first axis of rotation extending between the two lateral sides of the first support (or from one lateral side to the other), between a position for loading and for unloading a cartridge, and a position for connecting a cartridge to said means of fluidic connection;
- means for actuating the second cartridge support in rotation about the first axis.

The "back" side (or face or wall) can also be designated as the rear or back or bottom (face or side or wall).

Preferably said second support:

- is, in said position for connecting, at least partly contained, most preferably entirely contained, within the first support;
- and/or comprises means, for example an orifice or an opening, for connecting or for positioning a cartridge on said second support, which come opposite, or in contact, with means of fluidic connection of the back side of the casing or of the first support.

A cartridge can be maintained against the second support.

During a use, a cartridge is loaded onto, or against, the second support, a portion of the cartridge, for example the back side of the latter, being placed in, or in contact with, the means for connecting of the second support, then the second support is tipped towards the back side of the first support, bringing the cartridge into engagement with the means of fluidic connection of the back side of the casing.

The first support of a device according to the invention remains fixed in relation to the printer during the printing operations.

Each side and/or the back side can be perforated or have one or several openings.

According to an embodiment, the means for actuating the second cartridge support in rotation about the first axis comprise means guided in a groove linked to the second support.

The first axis is more preferably fixed in translation in relation to each one of the lateral sides.

The device can furthermore comprise a second axis about which the means for actuating can be actuated in rotation. For example, this second axis is parallel to the first axis of rotation.

The means for actuating the cartridge support in rotation around the axis can comprise a handle or a hand grip or a lever in rotation about the second axis, which extends more preferably between two ends of the handle or of the hand grip or of the lever.

In said position for loading and for unloading of a cartridge, a portion of the second support can be outside the first support, which is advantageous for the loading and the unloading of a cartridge.

A device according to the invention can further comprise means, for example at least one spring, for returning the support into said position for loading and for unloading of a cartridge.

A device according to the invention can further comprise means for blocking the second support in the position for loading and for unloading a cartridge and/or in position for connecting. As such, during the loading and unloading operations and/or during the connecting of a cartridge to the fluidic circuit, the device is in a stable position.

Advantageously, the second support comprises means for blocking in order to block, in relation to the second support, a cartridge arranged on the latter. These means of blocking can be configured to block a cartridge only if it is in a given position, more preferably unique, in relation to second support.

The invention also relates to a compartment for at least one ink cartridge of an inkjet printer, comprising at least one device according to the invention, of which the first support is fixed in relation to said compartment.

Preferably, this compartment further comprises a device according to the invention, for at least one solvent cartridge. Here again, the first support is fixed in relation to said compartment.

The invention also relates to an inkjet printer comprising a print head, a circuit for supplying said head with ink and a compartment according to the invention, for at least one ink cartridge. Preferably, the printer also comprises a circuit for supplying said head with solvent and the compartment also comprises a device according to the invention, for at least one solvent cartridge. The cartridge or cartridges are separated from the print head, to which it/they is/are connected by a flexible line or a flexible umbilical link.

The invention also relates to a method for introducing a cartridge into an inkjet printer, using a device according to the invention, comprising:

- the positioning of said cartridge on the second support, the latter being in the position for loading;
- the actuating of the second cartridge support in rotation about the first axis in order to bring it, or to bring a nipple or a mouth (also called "nozzle") of the cartridge, into the position of fluidic connection with the means of fluidic connection of the back side of the first support.

Advantageously, the cartridge comprises a body (the body of the cartridge containing the ink or the solvent when the cartridge is not empty) and a nipple or a mouth (also called "nozzle"), said nipple comprising, successively along an axis (AA'), a first cylindrical zone of diameter $d_1$, and, between this first cylindrical zone and the body of the cartridge, a second cylindrical zone of diameter $d_2$, greater than $d_1$. The axis (AA') is preferably perpendicular to a wall of the cartridge.

The invention also relates to a method for introducing a cartridge into an inkjet printer, using a device according to the invention, further comprising means for blocking the second support in the position for loading and for unloading a cartridge and/or in position for connecting, the cartridge comprising a nipple, which comprises, successively along an axis, a first cylindrical zone of diameter $d_1$, and, between this first cylindrical zone and the body of the cartridge, a second cylindrical zone of diameter $d_2$, greater than $d_1$, the method comprising:

- the positioning of said cartridge on the second support, the latter being in the position for loading, the cartridge being blocked on this second support, in a blocked or locked position, more preferably unique, only if the second cylindrical zone of diameter $d_2$, is introduced into the means for blocking the cartridge;
- the actuating of the second cartridge support in rotation about the first axis in order to bring it into the position for connecting and to bring a nipple of the cartridge into fluidic connection with the means of fluidic connection of the back side of the first support.

The invention also relates to a method for extracting a cartridge from an inkjet printer, said cartridge being maintained in a device according to the invention and being in fluidic connection with the means of fluidic connection of the back side of the first support, this method for extracting comprising:

- the actuating of the second support in rotation about the first axis in order to bring the cartridge from the position of connecting to the position of loading and of unloading;
- the extraction of said cartridge from the second support.

During the implementation of a method according to the invention, the first support of a device according to the invention remains fixed in relation to the printer. The same therefore also applies to the cartridge positioned in this device, in particular on the first support, when the cartridge is in fluidic connection with the means of fluidic connection.

DETAILED DESCRIPTION OF EMBODIMENTS OF THE INVENTION

Figure 5A:
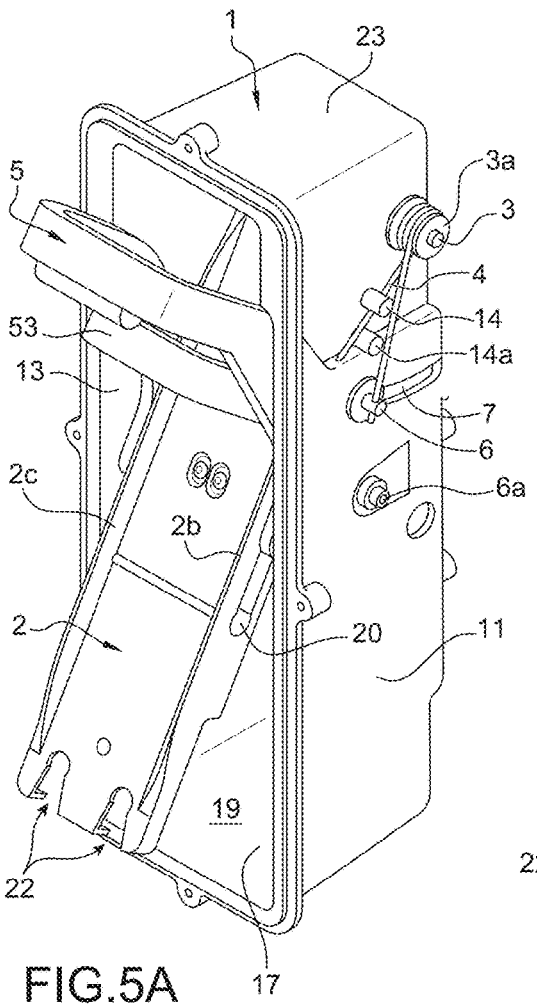
FIGS. 5A-5C show various aspects of a device according to the invention.
Figure 5B:
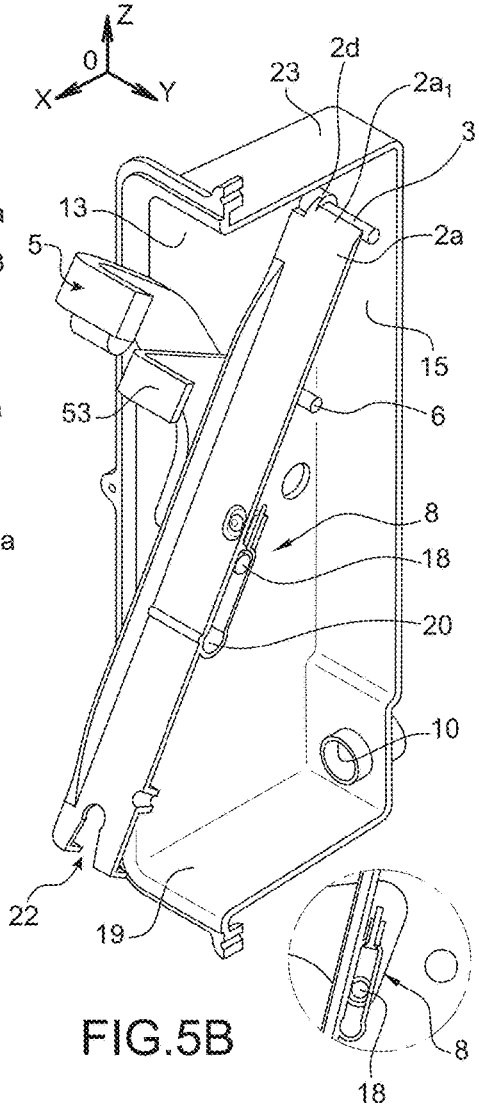
Figure 5C:
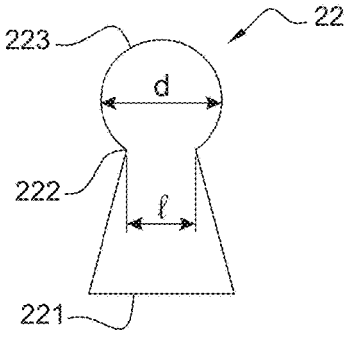

An embodiment of a structure of a cartridge support according to the invention is shown in FIGS. 5A-5C.

Figure 2:
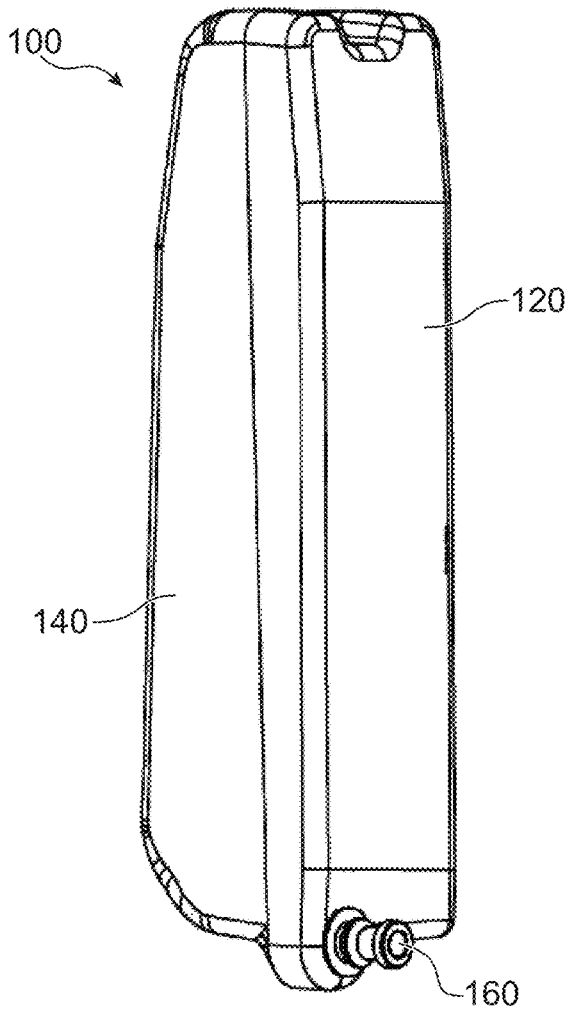
FIG. 2 shows an example of a CIJ printer cartridge.
Figure 3A:
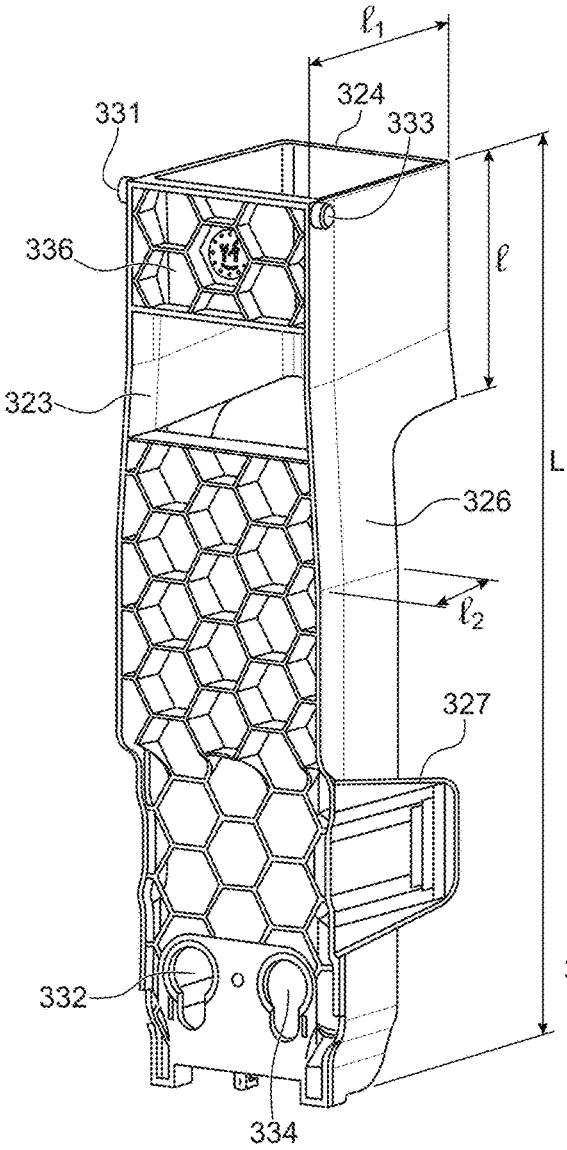
FIGS. 3A and 3B show a cartridge holder, the latter containing, in FIG. 3B, a cartridge.
Figure 3B:
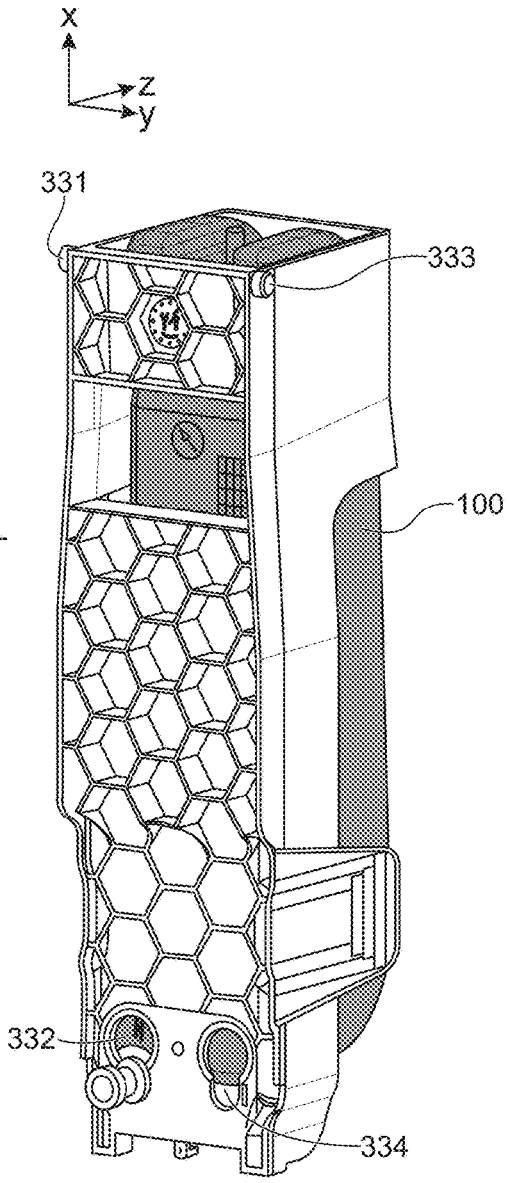

It comprises a casing 1, delimited by two sides 11, 13, shown here in the form of solid lateral walls (but which could, alternatively, be aerated or perforated or provided with one or several openings), a back side 15 (or rear side or face or wall or bottom side or face or wall), also in the form of a solid wall (but which, alternatively, could also be aerated or perforated or provided with one or several openings), and a front opening 17, through which a cartridge, for example of the type described hereinabove in liaison with FIG. 2, can be inserted into the casing; the back side 15 is provided, for example in its lower portion, with means 10 of fluidic connection (these means can be seen more clearly in FIGS. 5B, 7A-7C), to which the nipple (or mouth, also called "nozzle") of a cartridge 160 is connected when the latter is inserted into the casing; a lower wall 19 and an upper wall 23 delimit the casing according to a direction Z. The back side 15 faces the front opening 17 or is opposed to said front opening. In the rest of the description, the expression "back side" or "back wall" will be used but is intended to mean the "rear" or the bottom or the wall or face facing the front opening 17 or opposed to said front opening. These means 10 comprise for example a cannula, connected to the circuit for supplying the printer, for example, with solvent or ink. This cannula pierces the nipple 160 in order to put the inside of the cartridge and the supply circuit into fluidic communication.

The device further comprises a cartridge support 2, able to be actuated in rotation about a first axis 3 of rotation of the support; this axis, (preferably arranged in the upper portion of the casing (according to the axis Z)), extends between the two sides 11, 13 of the casing and is mainly fixed with respect to the latter (at least in translation, while still retaining lateral clearance, this axis able to be free in rotation about itself). As such, the support can be displaced between a position for loading and for unloading a cartridge (position shown in FIGS. 5A and 5B, as well as in FIGS. 6C and 7C), and a position for connecting a cartridge to said means 10 of fluidic connection (position shown in FIG. 6A as well as in FIG. 7A). The movement of the support 2 takes place in a plane ZOX, which is perpendicular to the back side 15. Advantageously, the first axis 3 of rotation is located in the vicinity of the upper portion 2*a* of the support, which is articulated on the axis 3. For example the latter is parallel to an upper edge $2a_1$ of the support. The articulation on the axis 3 can be carried out using one or several pivots (s), which is/are arranged at the upper longitudinal end of the support 2, such as the pivot 2*d*, and whereon the axis 3 is articulated.

In the position for connecting, the cartridge support (and, when the latter is present, the cartridge that it supports) is at least partly contained, and preferably entirely contained, in the casing 1 (or the first support). It is then substantially parallel to the back side 15 (as in FIG. 7A). Preferably, in the position for loading/unloading, the lower portion of the cartridge support (and/or the farthest from the axis 3 of rotation of the support) exits from the casing 1, as can be seen in FIGS. 5A, 5B, 6C, 6D, 7C, which facilitates the loading and unloading operations of each cartridge: indeed, it is through this portion that exits from the casing that it is the easiest to load/unload a cartridge on the support. As shall be seen further on, the support can be locked (or blocked) in one and/or the other of the positions for connecting and for loading/unloading. The axis of rotation 3 makes it possible to provide a constant trajectory of the support 2 for each cartridge, of which the nipple 160 is as such brought to the means 10 of fluidic connection.

The support 2 more preferably defines a plane, in relation to which a cartridge (or the body of a cartridge, said body of the cartridge containing the ink or the solvent when the cartridge is not empty) can be positioned in a fixed manner; for example, at least one portion of the face of a cartridge that comprises the nipple 160 can be positioned against this plane.

Laterally, edges 2*b*, 2*c* can prevent a displacement, according to the Y axis, of a cartridge positioned on the support.

Means 5 are provided to drive the cartridge support 2 in rotation about the first axis 3, whether for driving the support from the position for loading and for unloading to the position for connecting, or inversely. These means have, in the example shown, the form of a handle, a lever or a hand grip; they can be actuated in rotation about a second axis 6*a* (see FIGS. 5A and 7C), parallel to the first axis 3 of rotation and fixed in relation to the casing 1. It is for example materialised, in each side 11, 13, by a pivot; for example, this second axis of rotation extends between two lateral ends of the handle, each one of these ends being pivotably mounted about itself in one of the sides 11, 13 (one of these lateral ends of the handle, which bears the reference 51, can be seen in FIG. 7C). These means 5 are housed, in the position of connecting of the cartridge, inside the casing, in the bottom of the latter, under the lower portion of the cartridge, as can be seen in FIGS. 6A and 7A.

A groove 7, in the shape of an arc of circle, can be provided in each one of the sides 11, 13 of the casing 1. It allows for the movement of rotation, about the first axis 3, of another axis 6 linked to the support 2, of which the ends are driven in said groove 7 during a displacement of the support 2 about the axis 3. This axis makes it possible to transmit the force of the means 4 explained hereinbelow.

Figures 6A, 6B, 6C, 6D:
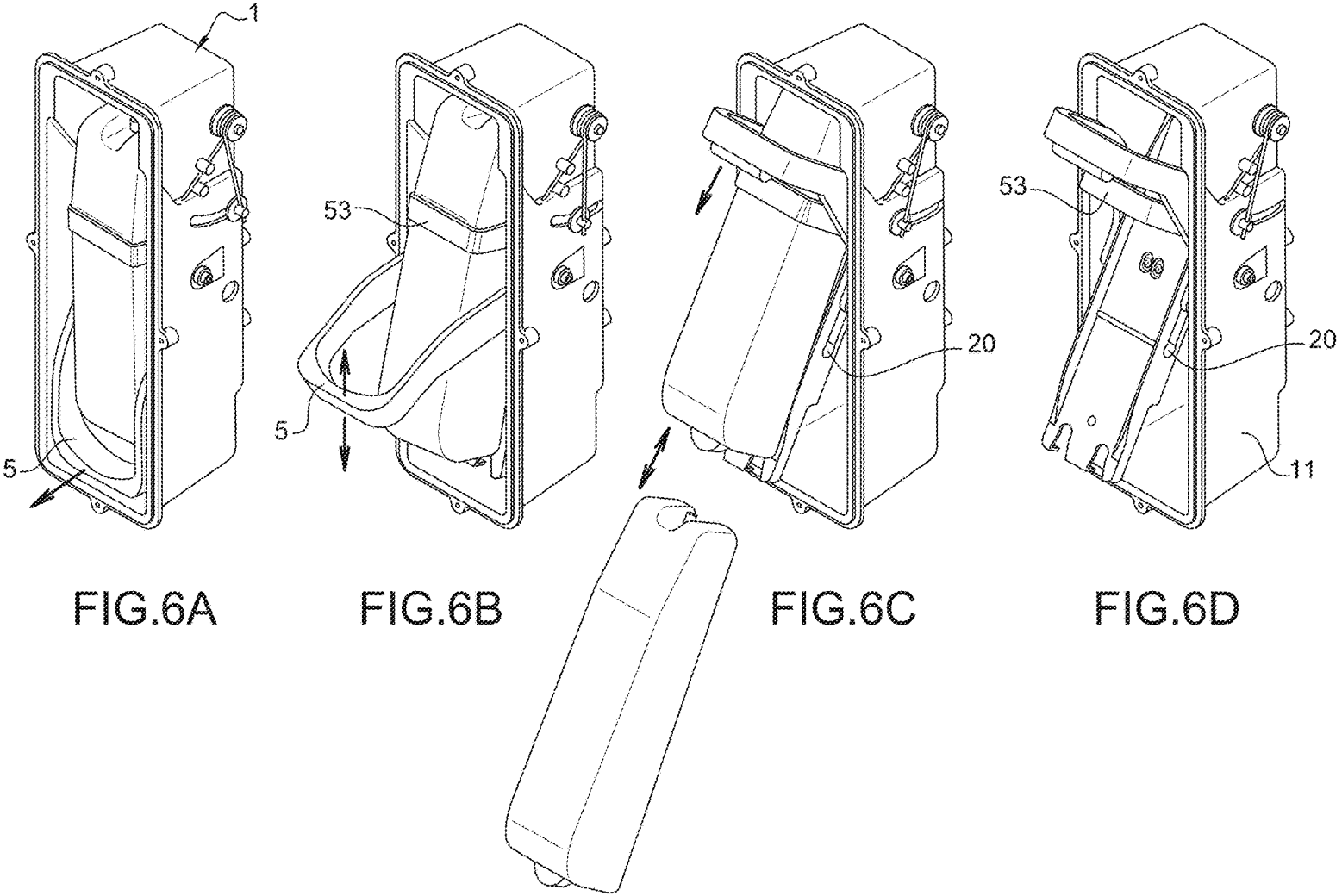
FIGS. 6A-6D and 7A-7C show operating steps of aspects of a device according to the invention.
Figure 7C:
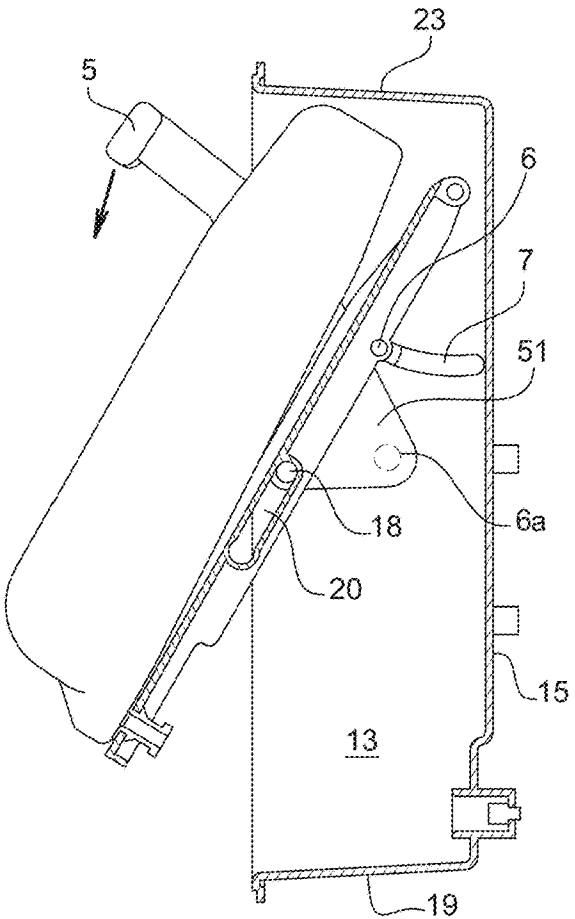
Figure 7B:
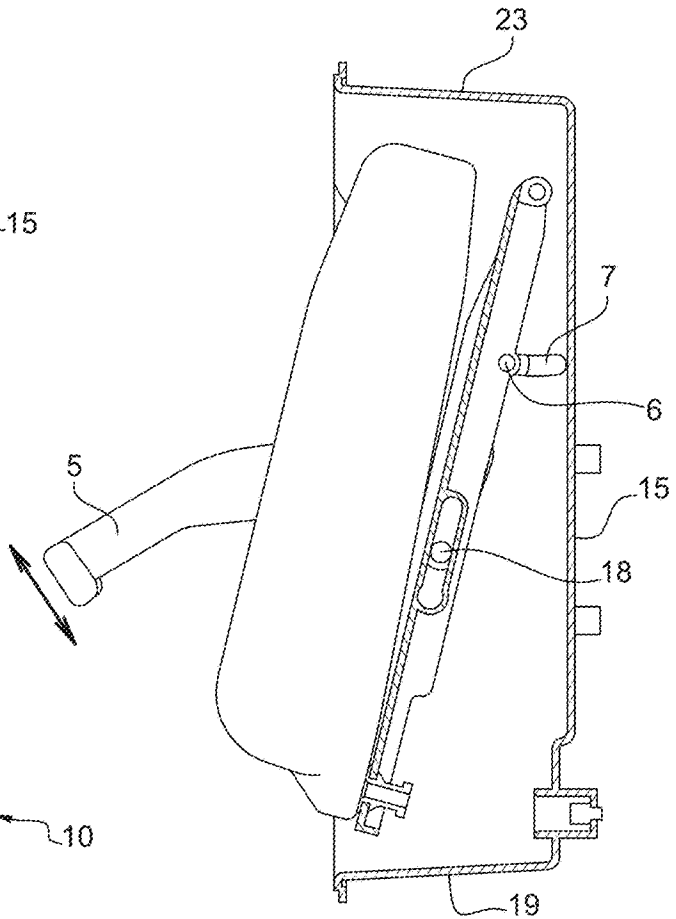
Figure 7A:
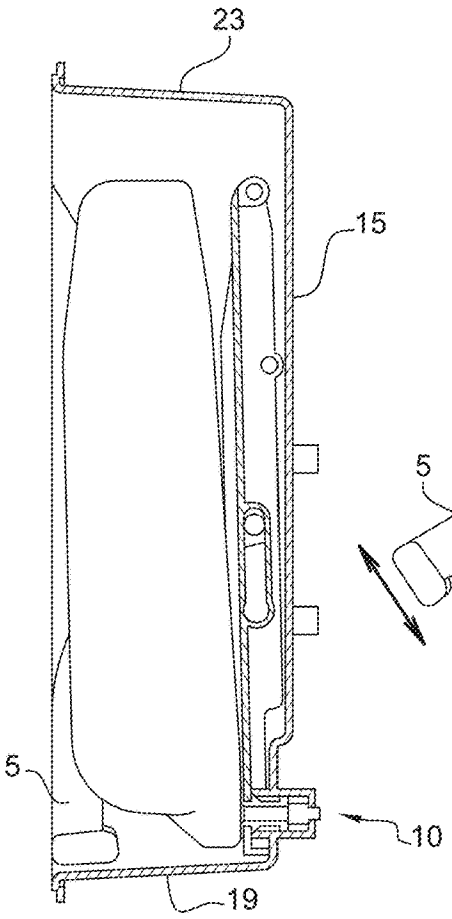

Means 4 forming a spring, for example a torsion spring, can be provided in order to exert a pressure on the support 2, in such a way that the latter is driven into the open position as soon as it is released from its position for connecting shown in FIGS. 6A and 7A. These means 4 exert a resistance on the support 2 as soon as the latter is driven from its open position, shown for example in FIGS. 5A, 5B and 6C, to its position for connecting. These means are more preferably arranged outside the volume which makes it possible to receive a cartridge, for example on a lateral wall of the casing. According to an embodiment shown in FIG. 5A, this spring comprises a body wound on a stud 3*a* positioned against the outer surface of the wall 11, and two ends, of which one is maintained between two support points 14, 14*a* also fixed on the outer surface of the side 11 of the casing. Advantageously, the stud 3*a* is in the extension of the axis 3 of rotation, but it could be elsewhere on the side 11 or the surface thereof. Another end is for example linked to the end 6 of the axis linked to the support 2, with this axis transmitting the force from the means 4 to the support 2. The winding of the spring can rotate with the support. A set of identical or similar means can be provided against the outer surface of the wall 13 of the casing.

Alternatively, at least one spring can be arranged in the casing 1 in order to provide the functions hereinabove (driving the support into the open position as soon as it is released from its position of connecting shown in FIGS. 6A and 7A; exerting on the latter a resistance as soon as the latter is driven from the open position thereof, shown for example in FIGS. 5A, 5B and 6C, to the positioning of connecting thereof).

These means forming a spring have a favourable effect on the ergonomics of the whole of the device by participating in the good maintaining of the support 2. At least one groove 20 (which can be seen in FIGS. 5A, 6C, 6D, 7A-C), can be formed in the support 2, for example along the latter and/or along a surface opposite the surface whereon each cartridge can be positioned, so as to guide the means 5, in the movement of rotation about the second axis 6*a*, by means 18, for example a third axis or studs (aligned along this axis), fixed, for example by screwing in the lateral ends 51 of the means 5. The means 18 and 20 form a set of means for transmitting, to the support 2, the movement of rotation of the handle 5. This same axis 18, or these same studs, is/are located at a constant distance from the second axis 6*a*. It or they make it possible to act on the support in order to push it into its locked position or to pull it from this same locked position. According to the Y axis (FIGS. 5A, 5B), the groove extends preferably from one lateral edge to the other of the support. When the support 2 is in the position for loading or of unloading, the means 18 are in the top position in the groove 20. When the support is driven from the position for loading/unloading to the position for connecting, these means undergo a downward movement of the groove, in fact in rotation about the second axis 6*a*. When the support 2 is in the position for connecting, the means 18 are in the top position in the groove 20.

Means 8 (which can be seen in FIG. 5B; these means comprise for example a lock, or possible clips) can be provided to block the means 18, linked to the means 5, when the support is in the position for connecting (position shown in FIGS. 6A and 7A) as well as when it is in the position for loading and for unloading (FIGS. 6D, 7C) in order to allow for the positioning of the cartridge on a stable support. The blocking of the means 18 drives that of the means 5 and of the support 2, when the latter has reached the position for loading/unloading or the position for connecting. When the support 2 has reached the position for loading/unloading a push on the means 5 makes it possible to unblock the means 18. When the support 2 has reached the position for connecting, a traction on the means 5 makes it possible to unblock the means 18

Means 22 can be provided, in the lower portion of the support 2, in order to block the cartridge in position against the latter, using the nipple of the cartridge. The cartridge is thus connected or positioned on or against said second support. These means 22 (FIG. 5C) have the form of one or several openings, each one comprising for example a portion 221 for introduction that is wide, which narrows to a neck 222, which forms chord of an arc of circle 223. The diameter d of this arc of circle is greater than the length I of the chord and substantially corresponds to the diameter of the nipple of a cartridge.

As such, a cartridge is introduced by positioning the nipple in the wide portion 221, then by bringing it towards the narrowed portion formed by the neck 222, obliging the operator to force the introduction of the cartridge in order to be able to introduce the nipple into the circular portion 223. The cartridge is then in locked or blocked position in relation to the support 2. An operator must also apply force to extract the cartridge from the circular portion 223. The presence of several openings 22 (see FIG. 5A) makes it possible to position cartridges with a nipple positioned differently, for example according to whether it is a solvent cartridge or an ink cartridge. Such a system makes it possible to carry out a unique position of blocking or of locking of the cartridge in relation to the support.

Advantageously, the nipple 160 of the cartridge has successive zones comprising two different diameters, with one of the diameters (the farthest from the body of the cartridge) not allowing for blocking, in the way explained hereinabove, in the means 22 of the cartridge, while the other (the closest to the body of the cartridge) allows for blocking.

Figure 5D:
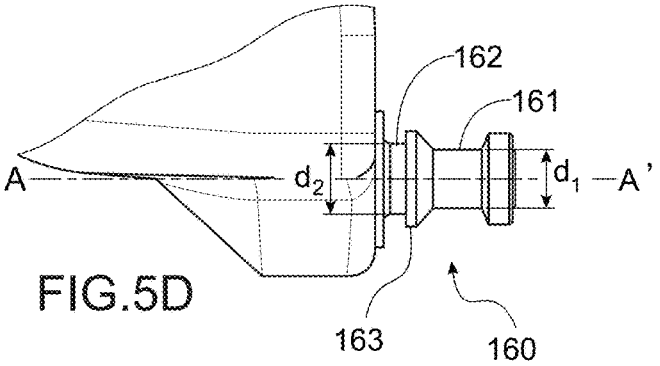
FIG. 5D shows an embodiment of a nipple of a cartridge.

This structure is shown more precisely in FIG. 5D (wherein only the bottom of the cartridge is shown): the nipple comprises, successively along an axis AA', a first cylindrical zone of diameter $d_1$, less than the distance I of FIG. 5C, in such a way that this portion does not allow for the blocking of the cartridge by the neck 222. As can be seen in FIG. 5D, the axis AA' is perpendicular or substantially perpendicular to at least one portion of the wall of the cartridge intended to be turned towards the plane which can be defined by the support 2, plane with respect to which a cartridge can be positioned in a fixed manner, and/or towards the back side 15.

When the body of the cartridge is approached, the nipple comprises a second cylindrical zone of diameter $d_2$, greater than the distance I of FIG. 5C, in such a way that this portion allows for the blocking of the cartridge by the neck 222.

As such the nipple 160 of the cartridge comprises, successively along the axis (AA'), a first cylindrical zone of diameter $d_1$, and, between this first cylindrical zone and the body of the cartridge, a second cylindrical zone of diameter $d_2$, greater than $d_1$.

These two zones 161,162 can be separated by a protrusion 163.

As such, if the cartridge is not sufficiently thrust against or maintained against the support 2, in such a way that the zone 162 cannot be introduced into the means 22, then it cannot be blocked (in the position, preferably unique, of blocking or locking) and falls back along the support 2. This has the advantage of indicating to the user that he has not placed the cartridge correctly and of preventing any error in positioning that could lead to incorrect use of the latter.

A flange 53 can be provided (FIGS. 5A, 5B, 6D) of which the ends are fixed on either side of the support 2. This flange makes it possible to:

- thrust the cartridge against the support 2 and to correctly position it;
- limit the deformation of the cartridge when the latter is being emptied.

The device described hereinabove is provided for a vertical configuration of the cartridges, as illustrated on FIGS. 5A and 5B assuming the axis Z is oriented vertically, or along or in the direction of gravity.

But, alternatively, the device can be provided to position a cartridge horizontally, or according to any other inclination. The shape of the cartridge is consequently adapted. In the case of a cartridge positioned horizontally, wall 15 is positioned horizontally, perpendicular to axis X which is oriented vertically, or along or in the direction of gravity.

A device according to the invention is described hereinabove comprising a casing 1. Alternatively, it is possible to use a frame or, more generally, a support (or first support), delimited laterally by two sides 11, 13, and comprising a back side 15 and a front opening 17. The first support allows for the maintaining of the axes 3 and 6*a*, which cooperate as explained hereinabove and is provided with means 10 of fluidic connection already described hereinabove. This first support cooperates with the second support 2, which is mobile in rotation inside the first support, in the way already explained hereinabove. The other elements described hereinabove can be used in the framework of this alternative, for example the spring 4 with corresponding lateral supports or arranged in the support, between the back side 15 and the second support 2.

A device according to the invention is mounted in the cartridge compartment of an inkjet printer, the casing 1 being fixed in this compartment. As such, the support or the casing 1 is fixed in the compartment 400 shown in FIG. 4A, which then no longer comprises the means 105*a-c*. The orifice 10 is arranged facing or around the means 112*c* and allows for a connection to the fluidic circuit of the printer. A second device (identical or similar to the first device according to the invention), also fixed in the compartment 400, makes it possible to receive and to position a second cartridge, for example of solvent if the first cartridge is an ink cartridge. The orifice 10 of this second support comes opposite or around means 114*c* and allows for a connection to the fluidic circuit for supplying the printer with ink and possibly with solvent. As such the cartridge compartment of an inkjet printer comprises more preferably two devices according to the invention, one for the ink, the other for the solvent, both being fixed in this compartment.

A cartridge compartment of this type remains fixed in relation to the whole of the printer.

An example of the operation of the system shall now be described.

Starting from the locked position shown in FIGS. 6A and 7A, position wherein the means 5 are housed in the casing 1, these means 5 are actuated in rotation by the operator.

The axis 18, or the studs, are driven in rotation about the second axis 6*a* while still being maintained in the slot 20 and drive the support 2 in their movement (FIGS. 6B, 7B).

Simultaneously, the spring 4 tends to push the support 2 towards the outside of the casing, in order to release the cartridge from the casing (or bring it to the position for unloading).

Once the position of unloading is reached (FIGS. 6C, 7C), this position is locked by cooperation of the means 8 and 18, forming a support point in order to maintain the support 2 in place and to facilitate the extraction of the cartridge. This extraction can take place via a movement in translation which releases the nipple 160 from the means 22. The lower portion of the support 2 is then more preferably outside the inner volume of the casing 1 (this position is shown in FIGS. 5A, 5B, 6C, 7C).

When a cartridge is inserted (FIG. 6C, 7C), the operations hereinabove are repeated, in the opposite order.

The support 2 is in locked position via cooperation of the means 8 and 18, forming a support point in order to maintain the support 2 in place and to facilitate the insertion of the cartridge.

If the cartridge is provided with a nipple 160 of the type described hereinabove in liaison with FIG. 5D, and if the portion 161, which has the smallest diameter, is inserted into the means 22, then the cartridge is not maintained by the latter and, in the case of a vertical cartridge holder, falls. If the portion 162, which has the largest diameter, is correctly inserted into the means 22, then the cartridge is maintained well by the latter, which guarantees the correct positioning of the cartridge.

Once the cartridge is maintained in position against the support 2, the operator then brings the means 5 to the lower portion of the casing, as such driving the support 2 in rotation about the axis 3. When the position for connecting has been reached, this position is again locked by cooperation of the means 8 and 18. The cartridge can as such be brought into the locked position of FIGS. 6A and 7A. The means 5 are, in the bottom position, housed in the casing 1.

An ink (or solvent) cartridge that can be used with a system according to the invention can be of the type that was described hereinabove in liaison with FIG. 2, comprising a portion 120 (this portion is the most rigid, but can however be deformed somewhat when the cartridge is empty) and a semi-rigid, or flexible, portion 140. The rigid portion 120 is provided with a rigid nipple 160 that allows for a hydraulic connection to the ink supply circuit.

Figure 1:
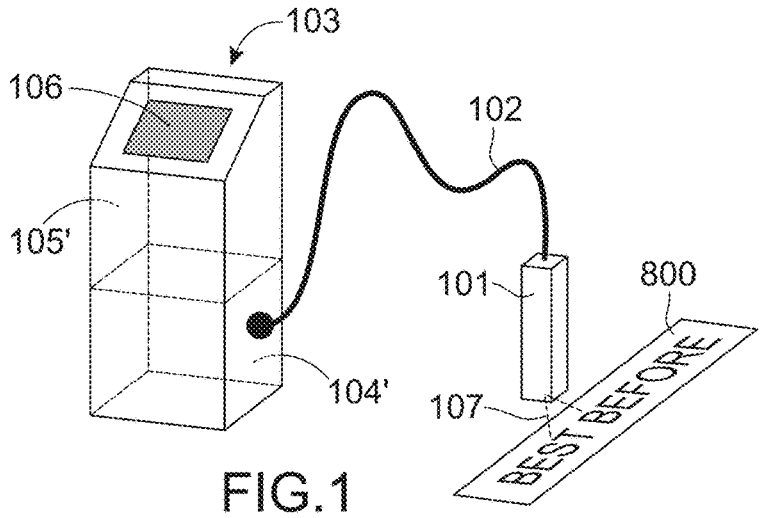
FIG. 1 shows a known structure of the printer of the CIJ type.

A device according to the invention, in particular a cartridge compartment such as described hereinabove, can be used in the framework of a device that has the structure shown in FIG. 1 and described hereinabove. In such a system, the cartridge or cartridges is/are separated from the print head 101, the supplying with ink of the latter being provided via a flexible line 102 (flexible umbilical link) that gathers together the hydraulic and electrical connections required for the operation of the head.

Alternatively, it is possible to use a cartridge that comprises a flexible or entirely deformable pouch, contained in a rigid box.

Figure 8:
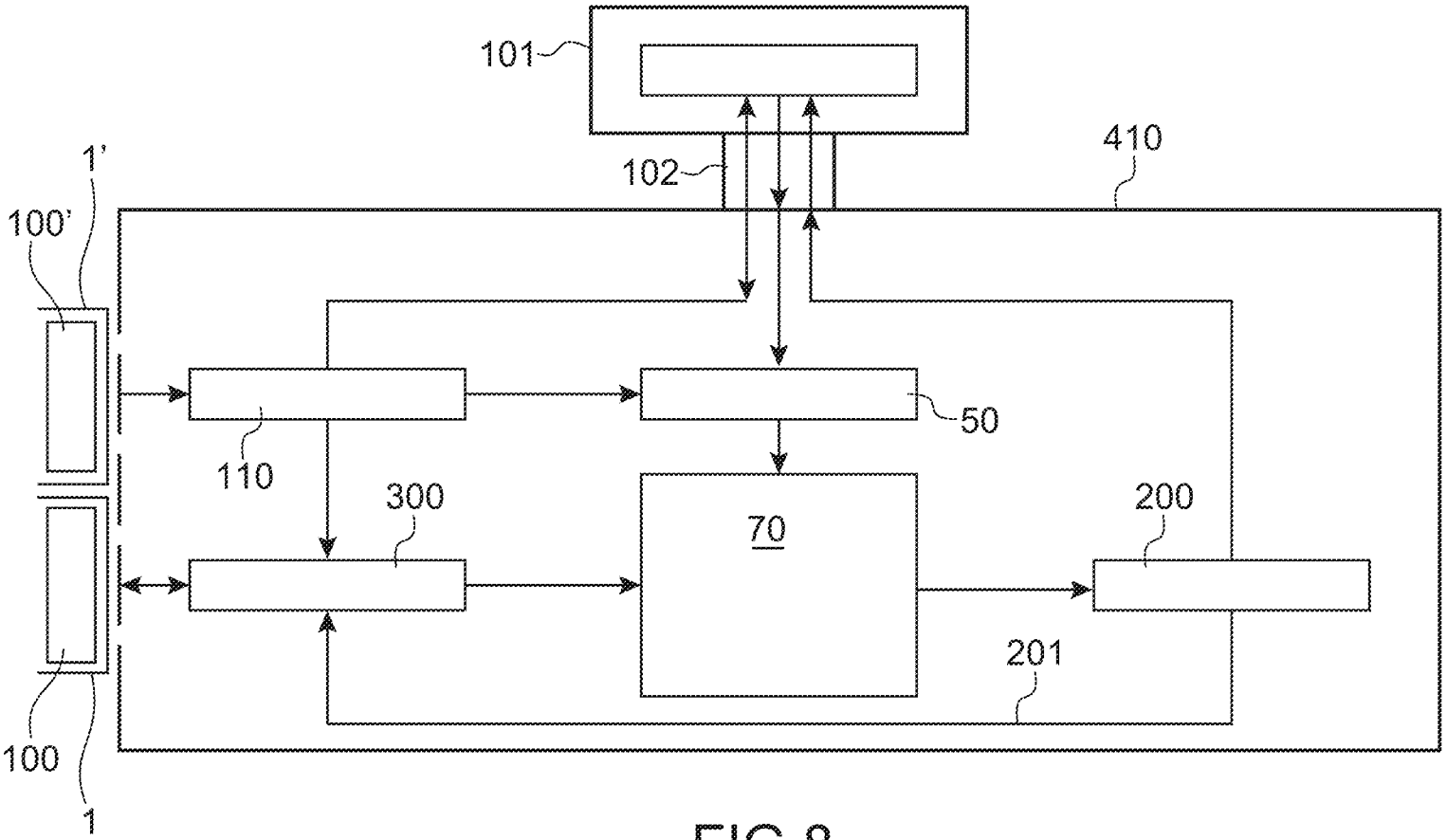
FIG. 8 shows an example of a structure of the fluidic circuit of a printer used with a device according to this invention.

An example of an architecture of the fluidic circuit of a printer to which the invention can be applied, is shown in FIG. 8. References identical to those already used hereinabove designate identical or corresponding elements. In particular, there is the flexible umbilical link 102, that gathers together the hydraulic and electrical connections and the print head 101, to which the printer architecture described hereinbelow can be connected.

In this FIG. 8, we see that the fluidic circuit 410 of the printer comprises a plurality of means 50, 70, 110, 201, 300, each one associated with a specific functionality.

Figure 4A:
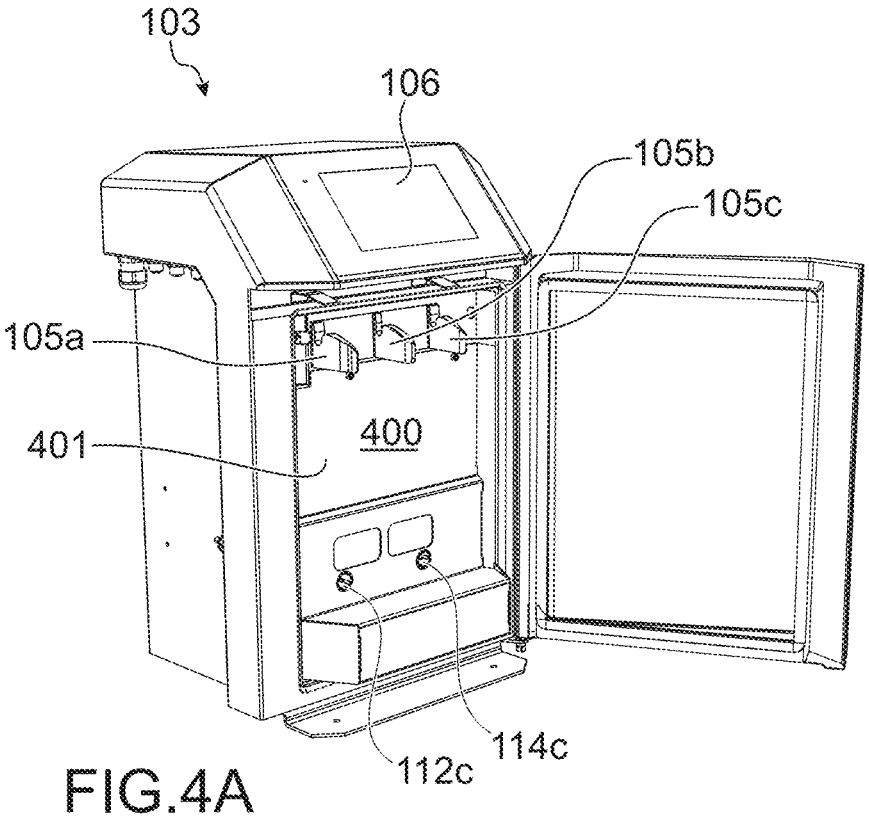
FIGS. 4A, 4B, 4D show various aspects of a compartment for the cartridges of a printer of the CIJ type
Figure 4B:
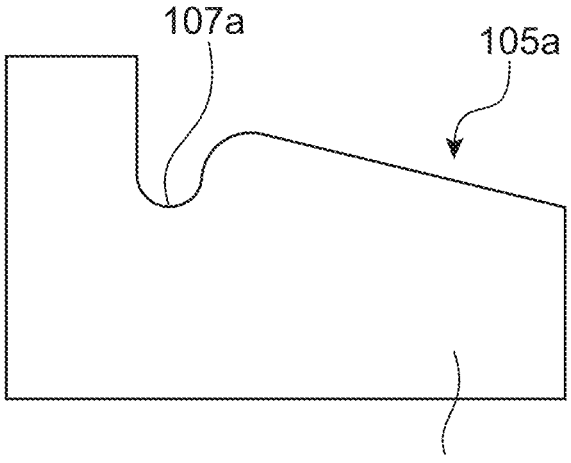
Figure 4C:
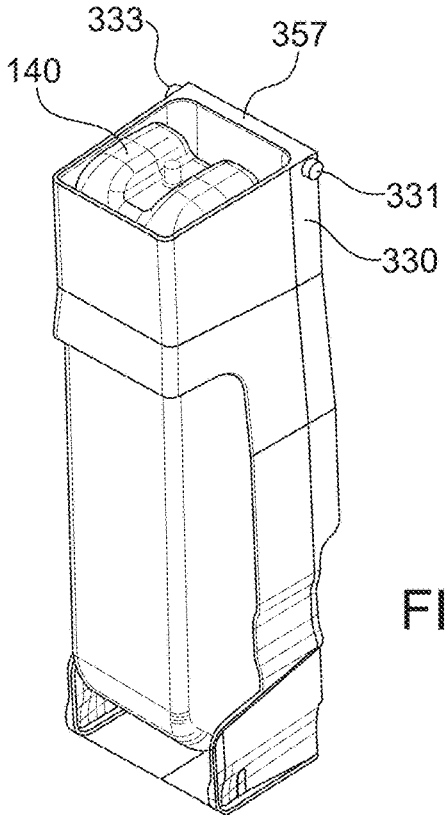
FIG. 4C shows a cartridge in its cartridge holder.
Figure 4D:
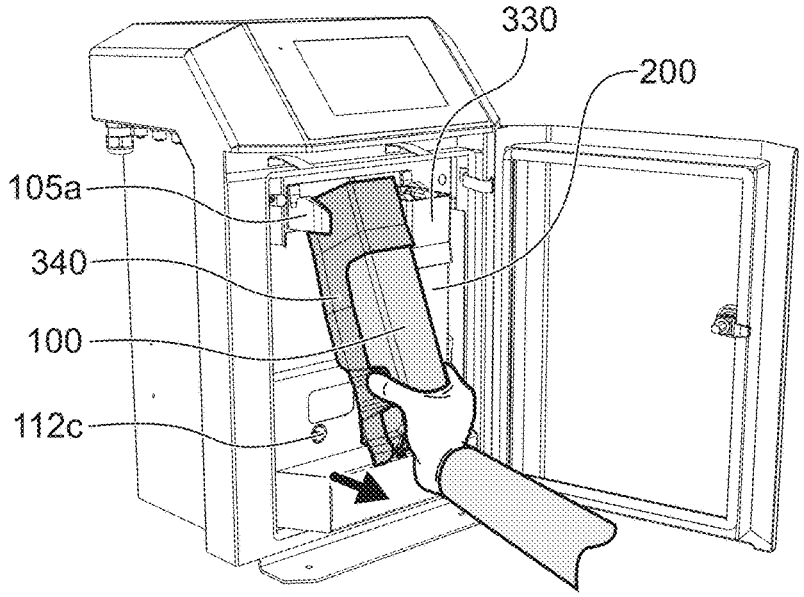

To this circuit are associated a removable ink cartridge 100 and a solvent cartridge 100', also removable, each one contained in a device 1, V according to the invention (which can be integrated into a compartment 400 such as described hereinabove in liaison with FIG. 4A).

The reference 70 designates the main reservoir, which makes it possible to receive a mixture of solvent and ink.

The reference 110 designates all of the means that make it possible to take, and possibly store, solvent from a solvent cartridge 100' and to provide the solvent taken as such to other portions of the printer, whether entailing supplying the main reservoir 70 with solvent, or cleaning or maintaining one or several of the other portions of the machine.

The reference 300 designates all of the means that make it possible to take ink from an ink cartridge 100 and to provide the ink taken as such for supplying the main reservoir 70. As can be seen in this figure, according to the embodiment shown here, the sending, to the main reservoir 70 and from the means 100, of solvent, passes through these same means 300.

At the outlet of the reservoir 70, a set of means, globally designated by the reference 201, makes it possible to pressurise the ink taken from the main reservoir, and to send it to the print head 101. According to an embodiment, shown here by the arrow 25, it is also possible, via these means 201, to send the ink to the means 300, then again to the reservoir 70, which allows for a recirculation of the ink inside the circuit. This circuit 201 also makes it possible to empty the reservoir into the cartridge 100 as well as to clean the connections of the cartridge 100.

The system shown in this figure also comprises means 50 for recovering fluids (of the ink and/or of the solvent) that return from the print head, more exactly from the gutter of the print head or from the rinsing circuit of the head. These means 50 are therefore arranged downstream of the umbilical link 102 (in relation to the direction of circulation of the fluids that return from the print head).

As can be seen in FIG. 8, the means 110 can also make it possible to send solvent directly to these means 50, without passing through the umbilical link 102 or through the print head 101 or through the recovery gutter.

The means 110 can comprise at least three parallel supplies with solvent, one to the head 1, the second to the means 50 and the third to the means 300.

Each one of the means described hereinabove is provided with means, such as valves, preferably solenoid valves, which make it possible to orient the fluid concerned to the chosen destination. As such, from the means 110, it is possible to send solvent exclusively to the head 1, or to the means 50 or to the means 300.

Other details of a printing machine to which the invention can be applied are given in the published application EP3112169.

The invention claimed is:

1. A device for introducing and maintaining of a cartridge in an inkjet printer of the CIJ type, comprising:

a first support, delimited by two lateral sides, a back side and a front opening, this first support able to contain a cartridge and the back side being provided with a fluidic connector;

a second support, called the cartridge support, against which the cartridge can be maintained, this second support able to be actuated in rotation about a first axis of a rotation extending between the two lateral sides of the first support, between a position for loading and for unloading the cartridge, and a position for connecting the cartridge to said fluidic connector, said second support being, in said position for connecting, contained within the first support and comprising at least an opening which come opposite, or in contact, with said fluidic connector of the back side of said first support; and an actuator of the second support in the rotation about the first axis.

2. The device according to claim 1, at least an axis or a stud of said actuator of the second support being guided in a groove linked to the second support.

3. The device according to claim 1, said first axis being fixed in a translation with respect to each one of the lateral sides.

4. The device according to claim 1, comprising a second axis about which the actuator can be actuated in the rotation.

5. The device according to claim 4, said second axis being parallel to said first axis of rotation.

6. The device according to claim 4, said actuator comprising a handle or a hand grip or a lever in rotation about the second axis.

7. The device according to claim 6, said second axis of the rotation of the hand grip extending between two ends of the handle or of the hand grip or of the lever.

8. The device according to claim 1, wherein, in said position for loading and for unloading of a cartridge, a portion of the second support is outside the first support.

9. The device according to claim 1, further comprising means for returning the support to said position for loading and for unloading of the cartridge.

10. The device according to claim 1, further comprising at least one spring for returning the support to said position for loading and for unloading of the cartridge.

11. The device according to claim 1, comprising means for blocking the second support in the position for loading and for unloading the cartridge and/or in position for connecting.

12. The device according to claim 1, comprising at least one lock or clips blocking the second support in the position for loading and for unloading the cartridge and/or in the position for connecting.

13. The device according to claim 1, the second support comprising at least one opening for blocking the cartridge arranged on the second support.

14. The device according to claim 13, said at least one opening being configured to block the cartridge only if the cartridge is in a given position with respect to the second support.

15. A compartment for at least one cartridge of the inkjet printer of the CIJ type, comprising at least one device according to claim 1, the first support being fixed with respect to said compartment.

16. The inkjet printer of the CIJ type comprising a print head, a circuit for supplying said head with ink and a compartment according to claim 15.

17. A method for introducing the cartridge into the inkjet printer of the CIJ type, using the device according to claim 1, the method comprising:

the positioning of said cartridge on the second support, the latter being in the position for loading; and the actuating of the second cartridge support in the rotation about the first axis in order to bring the cartridge into the position for connecting and to bring a nozzle of the cartridge into fluidic connection with the fluidic connector of the back side of the first support.

18. The method device according to claim 17, the cartridge comprises a nozzle, which comprises, successively along an axis (AA'), a first cylindrical zone of diameter $d_1$, and, between this first cylindrical zone and a body of the cartridge, a second cylindrical zone of diameter $d_2$, greater than $d_1$.

19. A method for introducing a cartridge into the inkjet printer of the CIJ type, using the device according to claim 13, the cartridge comprising a nozzle, which comprises, successively along an axis, a first cylindrical zone of diameter $d_1$, and, between this first cylindrical zone and a body of the cartridge, a second cylindrical zone of diameter $d_2$, greater than $d_1$, the method comprising:

the positioning of said cartridge on the second support, the latter being in the position for loading, the cartridge being blocked on this second support only if the second cylindrical zone of diameter $d_2$, is introduced into said at least one opening for blocking the cartridge; and the actuating of the second cartridge support in rotation about the first axis in order to bring the cartridge into the position for connecting and to bring a nozzle of the cartridge into a fluidic connection with the fluidic connector of the back side of the first support.

20. A method for extracting the cartridge from the inkjet printer of the CIJ type, said cartridge being maintained in the device according to claim 1 and being in a fluidic connection with the fluidic connector of the back side of the first support, this method for extracting comprising:

the actuating of the second support in the rotation about the first axis in order to bring the cartridge from the position of connecting to the position of loading and of unloading; and the extraction of said cartridge from the second support.

21. A device for introducing and maintaining of a cartridge in an inkjet printer of the CIJ type, comprising:

a first support, delimited by two lateral sides, a back side and a front opening, this first support able to contain the cartridge and the back side being provided with a fluidic connector;

a second support, called the cartridge support, against which the cartridge can be maintained, this second support able to be actuated in a rotation about a first axis of the rotation extending between the two lateral sides of the first support, between a position for loading and for unloading the cartridge, and a position for connecting the cartridge to said fluidic connector, said second support being, in said position for connecting, contained within the first support and comprising means of a connection of the cartridge which comes opposite, or in contact, with said fluidic connector of the back side of said first support; and an actuator of the second support in the rotation about the first axis.

* * * * *